United States Patent [19]

Shafai et al.

[11] Patent Number: 4,622,559

[45] Date of Patent: Nov. 11, 1986

[54] PARABOLOID REFLECTOR ANTENNA FEED HAVING A FLANGE WITH TAPERED CORRUGATIONS

[75] Inventors: Lotfollah Shafai; Ahmed A. A. Kishk; Ernest Bridges; Apisak Ittipiboon, all of Winnipeg, Canada

[73] Assignee: Canadian Patents & Development Limited, Ottawa, Canada

[21] Appl. No.: 599,711

[22] Filed: Apr. 12, 1984

[51] Int. Cl.[4] ..... H01Q 13/02

[52] U.S. Cl. ..... 343/786

[58] Field of Search ..... 343/786, 772, 777, 776, 343/778; 343/840

[56] References Cited

U.S. PATENT DOCUMENTS

| | | | |
|---|---|---|---|
| 2,665,383 | 1/1954 | Marie | 343/755 |
| 3,274,603 | 9/1966 | Kay | 343/786 |
| 3,553,707 | 1/1971 | Yang et al. | 343/786 |
| 3,943,521 | 3/1976 | Phillips | 343/786 |
| 4,504,836 | 3/1985 | Seavey | 343/786 |

FOREIGN PATENT DOCUMENTS

| | | | |
|---|---|---|---|
| 3144319 | 5/1983 | Fed. Rep. of Germany | 343/786 |
| 726058 | 3/1955 | United Kingdom | 343/786 |
| 1219872 | 1/1971 | United Kingdom | 343/786 |
| 2096399 | 10/1982 | United Kingdom | 343/786 |

*Primary Examiner*—Eli Lieberman
*Assistant Examiner*—Michael C. Wimer
*Attorney, Agent, or Firm*—Edward Rymek

[57] ABSTRACT

The antenna feed includes a waveguide radiator with a conductive flange positioned about the waveguide near its radiating end. The flange includes one or more corrugations which each have tapered walls and which is truncated at its root and crest by a flat or curved plane. The corrugations thus may have a trapezoidal cross-section or a curved root and crest cross-section. The curvature may be sinusoidal.

4 Claims, 6 Drawing Figures

PARABOLOID REFLECTOR ANTENNA FEED HAVING A FLANGE WITH TAPERED CORRUGATIONS

BACKGROUND OF THE INVENTION

This invention is directed to paraboloid reflector antennas, and in particular to a simple feed for these antennas.

The prime focus fed paraboloid is one of the most commonly used high gain antenna systems. It has been widely used in earth-station antennas, microwave relay systems and radio-telescopes. It has a simple geometry and is generally inexpensive to fabricate. It consists of a reflecting paraboloid surface with a feed system at its focus. Since the performance of this type of antenna relates closely to its feed, the feed has to be designed for high antenna efficiency and low cross-polarization, which can be achieved with a feed having a symmetric E and H plane radiation patterns. A common feed, which has been used because of its simplicity and low cost, is a waveguide radiator supporting the dominant mode. However, this type of feed generally has asymmetric E and H plane radiation patterns, thus causing a loss in the efficiency of the reflector and a high cross-polar radiation. High efficiency feeds with symmetric E and H plane patterns are normally designed using corrugated or multi-mode horns. A common design consists of a circular waveguide with a 90° corrugated flange, such as the one described in Canadian Pat. No. 873,547, which was issued to R. F. H. Yang et al on June 15, 1971, and which corresponds to U.S. Pat. No. 3,553,707, which issued on Jan. 5, 1971. It can be designed to have good symmetric patterns, to give high efficiency with reflector antennas, but due to its corrugated surface, is costly to fabricate. Recently, a feed with V-shaped corrugations has been described in a paper by C. A. Mentzer, J. R. Peters and F. B. Back, entitled "A corrugated horn antenna using V-shape corrugations", IEEE Trans., 1975, AP-23, pp. 93–97. These corrugations are somewhat easier to fabricate, however are still not satisfactory for mass production.

SUMMARY OF THE INVENTION

It is therefore an object of the invention to provide a corrugated flange antenna feed which is simpler to manufacture and operates satisfactorily in a wider frequency.

This and other objects are achieved in a feed for a paraboloid reflector antenna which includes a waveguide with a first end having an electrical coupler and a second radiating end. A conductive flange is mounted about the radiating end of the waveguide. At least one tapered corrugation is in the surface of the flange surrounding the waveguide, each corrugation has a truncated form at its root and crest.

In accordance with another aspect of the invention, each corrugation may be truncated at its root and crest by flat or curved planes which are substantially perpendicular to the direction of the waveguide. The curved planes may be substantially sinusoidal.

DETAILED DESCRIPTION

Figure 1:
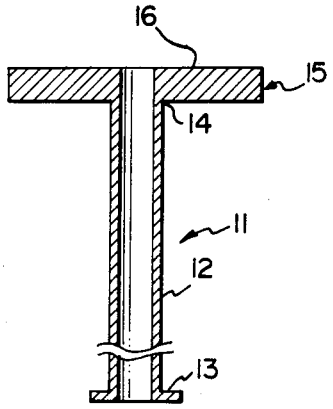
FIG. 1 illustrates, in cross-section, a general antenna feed in accordance with the present invention.

The antenna feed 11 shown in FIG. 1 consists of a waveguide 12 which would normally be circular about a longitudinal axis. One end of the waveguide 12 is fitted with a coupler 13, in any conventional manner, such that it may be electrically coupled to act as a transmitter or a receiver. The other end 14 of the waveguide may be open-ended or may include a transparent window which would be mounted in any conventional manner. In accordance with the present invention, the antenna feed 11 further includes a conductive corrugated flange 15 mounted about the waveguide 12 and electrically connected to it at the end 14 of the waveguide 12. In practice, the face 16 of the conducting corrugated flange 15 need not be in a plane perpendicular to the waveguide longitudinal axis. It may flare back over the guide or forward at an angle to take a conical shape, by which the beam width of the radiation patterns can be controlled. This beam width modification is often necessary to match the feed radiation pattern for efficient illumination of the paraboloid reflector. Various types of corrugations in the flange 15, in accordance with the present invention, are shown in cross-section in FIGS. 2, 4 and 6.

Figure 2:
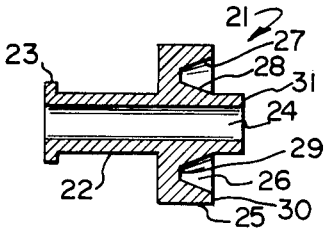
FIG. 2 illustrates a single corrugation feed.

The feed 21 in FIG. 2 includes a single corrugation 26 in the flange 25 at the open end 24 of waveguide 22. In this embodiment, the corrugation 26 has tapered walls 27 and 28 and is truncated at the root 29 and crest 30 to form a trapezoidal cross-section.

Figure 3:
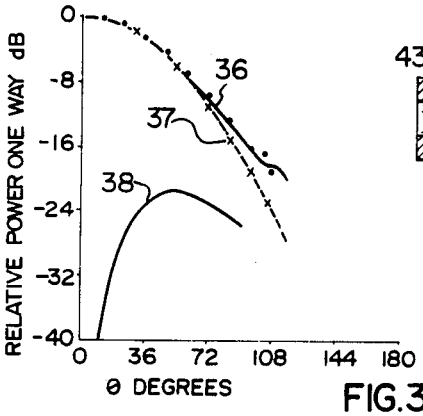
FIG. 3 illustrates the performance of a single corrugation feed.

FIG. 3 shows radiation patterus for the above feed 21. Curve 36 illustrates the radiation pattern in the E-plane, curve 37 the radiation pattern in the H-plane and curve 38 the cross-polarization. The symmetry of the radiation pattern is excellent for the first 60° off the axis, but the back lobes and the cross-polarization levels are high. In this embodiment, the extension 31 of the waveguide open end 24, beyond the flange surface may be used to improve the symmetry of the copolar patterns. However, while it improves the pattern symmetry, it causes the separation of the phase centers in the principal planes and thus deteriorates the cross-polarization. An angle of approximately 20° has been found to be desirable but may differ, if necessary, for ease of production. Satisfactory radiation patterns are generally obtained for corrugation depths near a quarter of a wavelength.

Figure 4:
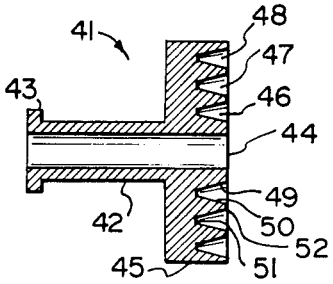
FIG. 4 illustrates a multiple corrugation feed.

The feed 41 in FIG. 4 includes three corrugations 46, 47, 48 in the flange 45 at the open end 44 of the waveguide 42. In feed 41 each corrugation 46, 47, 48, has tapered walls 49 and 50 and also is truncated at the root 51 and crest 52 to form corrugations with trapezoidal cross-sections.

Figure 5:
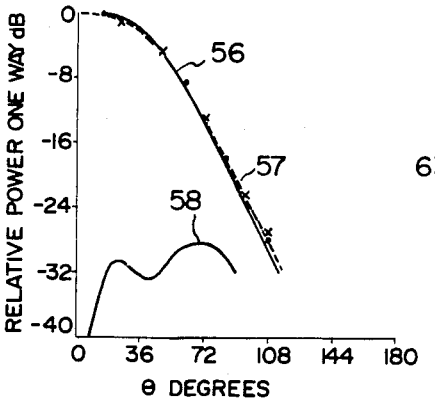
FIG. 5 illustrates the performance of the feed illustrated in FIG. 4.

As seen from the radiation patterns in FIG. 5, the E-plane radiation 56 is symmetrical with the H-plane radiation 57 up to at least the first 90°. In addition, the cross-polarization level 58 is much lower than for feed 21.

Figure 6:
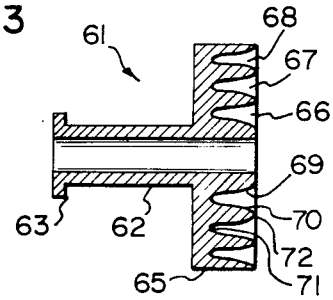
FIG. 6 illustrates a second multiple corrugation feed.

A third embodiment of the feed in accordance with the present invention is shown in FIG. 6. This feed 61 is similar to the feed 41 in FIG. 4 in that it has three corrugations 66, 67 and 68, with walls 69 and 70, which are not perpendicular to the flange 15 face. However, it differs in that the corrugations 66, 67 and 68 have curved sinusoidal cross-sections. In this feed, the optimum corrugation depth was found to be approximately 0.3 wavelengh.

Table 1 provides the performance of the feeds 21, 41 and 61, respectively, as a function of frequency from 11 GHz to 13 GHz. Comparing the results, one notes that for feed 21, the 10 dB beam width in the H-plane is constant within the band, and in the E-plane it increases with frequency.

TABLE 1

| Parameter | Feed Type | | | | | | | | | | | | | | |
|---|---|---|---|---|---|---|---|---|---|---|---|---|---|---|---|
| | Feed 1 | | | | | Feed 2 | | | | | Feed 3 | | | | |
| Frequency, GHz | 11 | 11.5 | 12 | 12.5 | 13 | 11 | 11.5 | 12 | 12.5 | 13 | 11 | 11.5 | 12 | 12.5 | 13 |
| $\theta_{10}$ dB | | | | | | | | | | | | | | | |
| E-plane | 134 | 138 | 140 | 145 | 146 | — | 130 | 124 | 118 | 113 | 142 | 126 | 123 | 117 | 112 |
| H-plane | 136 | 136 | 136 | 136 | 134 | — | 130 | 126 | 123 | 121 | 134 | 131 | 124 | 122 | 120 |
| Peak cross-polarization, dB | −22.24 | −21.63 | −21.5 | −20.72 | −20.61 | — | −21.94 | −28.44 | −28.8 | −28.19 | −18.56 | −27.03 | −27.45 | −28.92 | −28.27 |
| Back lobe, dB | −21.54 | −21.36 | −21.89 | −21.66 | −22.69 | — | −17.6 | −28.15 | −31.84 | −32.99 | −18.2 | −27.5 | −29.76 | −28.97 | −29 |
| Gain factor | | | 75.6% | | | | | 79.5% | | | | | 79.6% | | |

On the other hand, for both feeds 41 and 61, the 10 dB beam widths, in both planes decrease with increasing frequency. Comparing the peak cross-polarizations, it is evident that feeds 41 and 61 have a similar performance at high frequencies, but the performance of feed 61 at low frequencies is superior. For both feeds, the cross-polarization decreases with frequency. On the other hand, while for feed 21 both cross-polarization and the back-lobe levels are higher, they remain relatively constant over the assumed frequency band. This frequency independence is due to the waveguide extension beyond the corrugation surface, which compensates for the variations of the feed patterns with frequency. In a practical design, such a small waveguide extension can be used to further increase the bandwidth of a trapezoidally corrugated feed. It has not been incorporated in feeds 41 and 61 to show the performance of each corrugation shape with frequency.

Both trapezoidal and sinusoidal corrugation type feed have been found to operate satisfactorily. They have the added advantage of wider frequency band widths and being more suitable for mass-production methods such as casting or stamping and thus represent a substantial commercial advantage over most other known feeds.

Many modifications in the above described embodiments of the invention can be carried out without departing from the scope thereof and, therefore, the scope of the present invention is intended to be limited only by the appended claims.

We claim:

1. A feed for a paraboloid reflector antenna comprising:

a circular waveguide having a longitudinal axis, a first end having an electrical coupler and a second radiating end; and a conductive flange surrounding the radiating end of the waveguide and perpendicular to the longitudinal axis of the waveguide, said conductive flange having at least one corrugation therein wherein the corrugation has walls each of which is tapered inward along the depth of the corrugation.

2. The feed for a paraboloid reflector antenna according to claim 1 wherein each tapered corrugation is truncated at its root and crest by flat planes, forming a trapezoidal shape in cross-section.

3. The feed for a paraboloid reflector antenna according to claim 2 wherein the flat planes are parallel to each other and perpendicular to the waveguide longitudinal axis.

4. The feed for a paraboloid reflector antenna according to claim 1 wherein each tapered corrugation has a sinusoidal profile in cross-section.

* * * * *